United States Patent [19]

Bando et al.

[11] 4,232,853

[45] Nov. 11, 1980

[54] STEEL STOCK COOLING APPARATUS

[75] Inventors: Seiji Bando; Ebata Sadao, both of Okayama, Japan

[73] Assignee: Kawasaki Steel Corporation, Hyogo, Japan

[21] Appl. No.: 919,851

[22] Filed: Jun. 28, 1978

[30] Foreign Application Priority Data

Jul. 4, 1977 [JP] Japan ..... 52-89032
Aug. 22, 1977 [JP] Japan ..... 52-112674

[51] Int. Cl.[3] ..... C21D 1/62
[52] U.S. Cl. ..... 266/114
[58] Field of Search ..... 266/114, 121, 127, 128, 266/129, 134; 148/143, 146, 145

[56] References Cited

U.S. PATENT DOCUMENTS 3,659,428 5/1972 Kunioka et al. ..... 148/146

*Primary Examiner*—R. Dean
*Attorney, Agent, or Firm*—Koda and Androlia

[57] ABSTRACT

This steel stock cooling apparatus has injection pipes in each of which one end is communicated with a water supply portion, the other end is formed into an injection opening for injecting water supplied from the water supply portion and the intermediate portion is formed with at least one air introducing hole communicated with an air supply portion, whereby the water supplied is mixed with air supplied from the air introducing hole so as to be injected in the forms of droplets. The pattern of the injection is formed into an ellispe having its major axis in the direction of the air introducing hole, and desired patterns can be formed by changing the position where the air introducing hole is installed.

7 Claims, 10 Drawing Figures

STEEL STOCK COOLING APPARATUS

BACKGROUND OF THE INVENTION

1. Field of the Invention

The present invention relates to a steel stock cooling apparatus for water cooling in heat treatment of steel stocks.

2. Description of the Prior Art

Recently, there has been seen a strong tendency that it is planned to produce steel plates of high quality and decreased cost by heat treatment, particularly by water-cooling, and a great development has been marked in the so-called controlled cooling technique in which cooling is effected reliably in conformity with a desired cooling curve.

There have been generally adopted, as the cooling method of the type described above, a continuous cooling method in which, to uniformly and efficiently cool a steel plate, water or water mixed with air is injected from a nozzle onto the traveling steel plate. The cooling method is chosen from among a jet spray, a mist spray and a fog spray depending upon the type of the various desired cooling capacities.

In order to further efficiently effect cooling, it is necessary to form the above three types of injections consisting of water or water mixed with air by use of one type of nozzle in accordance with the desired cooling capacity. Namely, it becomes necessary to provide a cooling apparatus in which a stabilized cooling pattern is maintained and the cooling capacity is controlled over a wide range by use of a single nozzle.

Along with the progress of the continuous cooling method of the type described above, there has been widely seen the development in the controlled cooling technique in which, to efficiently manufacture steel stocks of high quality, cooling is effected in conformity with a predetermined cooling curve. There has been proposed an injecting apparatus using two fluids including water and air and capable of controlling the cooling capacity over a wide range by use of a single nozzle.

However, it is known that the injecting apparatus described above requires complicated manufacturing work, the cooling pattern thereof is limited to a circle, and is suitable for cooling a small area but inefficient in cooling a large area. Additionally, the conventional means has been still utilized in the technique of varying the cooling capacity by changing the flow rate, pressure and the like of water and air from the injection nozzle. The conventional control means as described above has been of the type in which the cooling capacity is controlled by changing the injected water stream and velocity of the mixed two fluids from the injection nozzle by separately controlling either one or both of the water flow rate (pressure) supplied and the air pressure (flow rate) supplied to the injection nozzle. Accordingly, with the conventional control means, there have been such disadvantages that, in the case that either the water amount supplied or the air pressure supplied is controlled, either one of the former or the latter is supplied beyond the need to result in not only the waste of power but the failure in obtaining the cooling capacity over a wide range, and in the case that both the water amount and the air pressure are separately supplied, the control is difficult to be conducted, because the varying of either one of the former or the latter is followed by the fluctuation of the other, whereby troublesome valve operation is necessitated to obtain a required cooling capacity, thereby making the conventional control means unfitted for the controlled cooling apparatus for steel stocks, which requires a speedy and accurate control.

SUMMARY OF THE INVENTION

In view of the above facts, an object of the present invention is to provide a steel stock cooling apparatus having a cooling capacity over a wide range, being simple in manufacturing work and suitable for cooling a large area.

Another object of the present invention is to provide a steel stock cooling apparatus readily controllable and capable of reliably controlling the water flow rate and the air pressure and capable of controlling the cooling capacity over a wide range and unrestrictedly.

The steel stock cooling apparatus according to the present invention is constructed such that: at least one air introducing hole communicated with an air supply hole is provided at the intermediate portion of each of injection pipes communicated at the ends on one side to a water supply chamber, whereby a mixed fluid of water with air is injected from the ends on the other side of the injection pipes, thereby enabling to cool over a wide range; a constant flow rate device is provided on an air supply pipe communicated with the air supply hole to make the flow rate of air supplied constant; and while, a flow rate valve is provided on a water supply pipe communicated with a water supply hole to control the flow rate of water supplied; whereby the cooling capacity is varied by changing the flow rate of water and the injection velocity from the injection pipes.

DESCRIPTION OF THE PREFERRED EMBODIMENT

Figure 1:
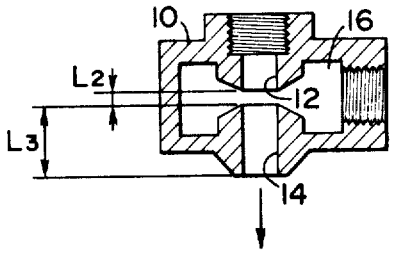
FIG. 1 PRIOR ART
FIG. 1 is a sectional view showing the nozzle for cooling the steel stocks as has been proposed in the prior art.

For the better understanding of the present invention, description will hereunder be given of the cooling nozzle capable of varying the cooling capacity over a wide range, which has been proposed in the prior art. (See Japanese Patent Application No. 51-154435) In the cooling nozzle shown in FIG. 1, a first and a second injection openings 12 and 14 which are integrally formed on the main body 10 of the nozzle are disposed on the same axis the end portions of both injection openings are opposed to each other at some distance apart from each other and those opposed portions are surrounded by an air chamber 16. With this arrangement, the pressure of water supplied from the first injection opening 12 and the pressure of air supplied from the air chamber 16 are controlled, thereby controlling the cooling capacity by the water stream injected from the second injection opening 14 over a large range.

As described above, the cooling nozzle has complicated construction, and the cooling pattern thereof is limited to a circle. Additionally, the varying of the cooling capacity of the cooling nozzle has been made by still utilizing the conventional control means.

Figure 2:
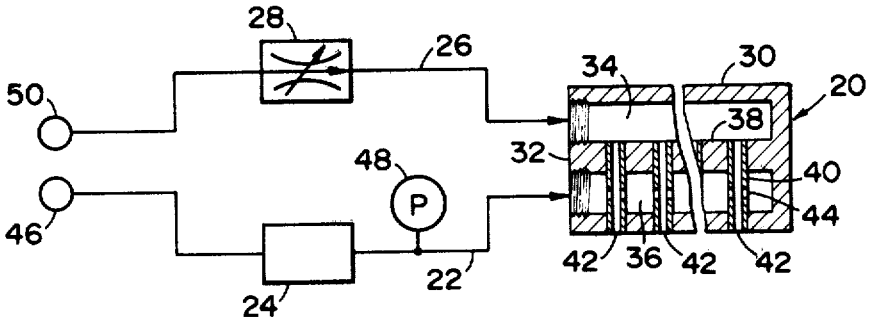
FIG. 2 is a flow diagram showing one embodiment of the steel stock cooling apparatus according to the present invention.

Description will hereunder be given of one embodiment of the steel stock cooling apparatus according to the present invention with reference to the drawings. As shown in FIG. 2, the steel stock cooling apparatus according to the present invention consists of an injection nozzle 20, a constant flow rate device 24 provided on an air supply pipe 22 communicated with the injection nozzle 20, and a flow rate control valve 28 provided on a water supply pipe 26 communicated with the injection nozzle 20.

Figure 3:
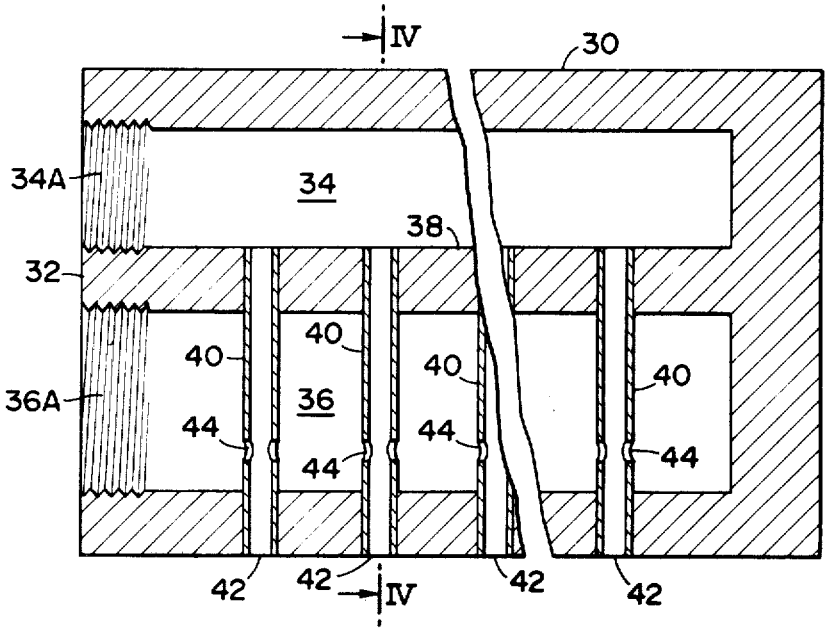
FIG. 3 is a sectional view showing the injection nozzle.
Figure 4:
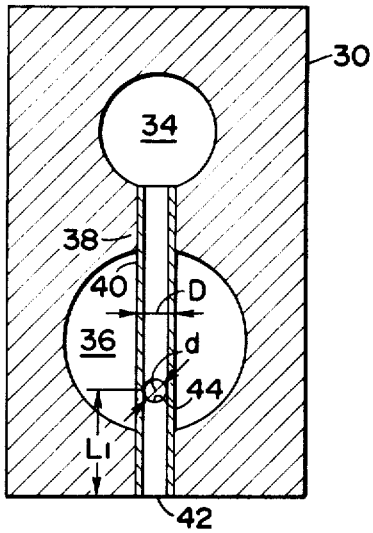
FIG. 4 is a sectional view taken along the line IV—IV in FIG. 3.

As shown in FIGS. 2 and 3, the main body 30 of the injection nozzle 20 is of a block-like shape, penetratingly provided at one end face 32 thereof with a water supply hole 34 and an air supply hole 36, both of which are bottomed columnar holes disposed parallelly and in spaced apart relation from each other. The water supply hole 34 and the air supply hole 36 are divided by a partition wall 38. These supply holes 34, 36 are provided at the end portions thereof on the side of the end face 32 with internal threads 34A, 36A, respectively, which are for use in connecting to the water supply pipe 26 and to the air supply pipe 22, respectively.

Next, a plurality of injection pipes 40 perpendicularly intersecting the axis of the water supply hole 34 and the air supply hole 36 are embedded at suitable intervals from one another in the main body 30 of the nozzle 20.

Ends of the injection pipes 40 at one side penetrate the partition wall 38 being communicated with the water supply hole 34 and ends of the injection pipes 40 on the other side are communicated with the outside of the main body 30 of the nozzle to form injection openings 42. Additionally, the intermediate portions of the injection pipes penetrate the air supply hole 36 perpendicularly to the axis thereof. The intermediate portions of the injection pipes are each penetratingly provided at portions thereof with air introducing holes 44, whereby the interiors of the injection pipes are communicated with the air supply hole 36, thereby forming the water within the injection pipes into droplets. The air introducing holes 44 each have an axis perpendicular to the axis of the injection pipe 40 and in parallel to the axis of the air supply hole 36.

With the above arrangement of the present embodiment, water is supplied from the water supply pipe 26 to the water supply hole 34 and, likewise, air is supplied to the air supply hole 36, whereby the water from the water supply holes 34 and the air mixed into the injection pipe 40 through the air introducing hole 44 are blown out of the injection openings 42 in the form of droplets, thus forming an injection stream capable of efficiently cooling. Additionally, this injection nozzle 20 is constructed such that the flow rate of water supplied from the water supply pipe 26 to the water supply hole 34 is controlled, whereby the amount of air supplied from the air supply hole 36 to the injection pipe 40 is controlled, so that the amount of injected water and injection velocity of the two fluids injected from the injection openings 42 can be changed, thereby enabling to vary the cooling capacity.

Figure 5A:
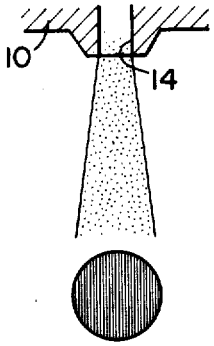
FIG. 5A PRIOR ART
FIG. 5 A is an explanatory view showing the cooling pattern by the conventional cooling apparatus, FIG. 5 B is an explanatory view showing the cooling pattern by the present embodiment.
Figure 5B:
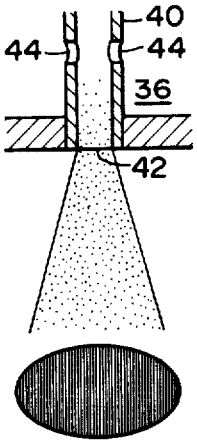

This injection becomes an elliptical injection stream having mojor axis in the direction in which the air introducing holes 44 as shown in FIG. 5 B. Additionally, the cooling pattern is controllable by changing the distance $L_1$ between the air introducing hole 44 and the injection openings 42 and the diameter d of the air introducing hole 34.

As an example, in the case the distance $L_1$ between the air introducing hole 44 and the injection openings 42 is made 9 mm, the inner diameter D of the injection pipe 40 is made 2.5 mm and the diameter of the air introducing hole 44 is made equal to the inner diameter of the injection pipe, an elliptical cooling pattern was obtained which has a major axis of 150 mm and a minor axis of 75 mm at the distance of 500 mm from the injection openings 42. On the other hand, with the conventional apparatus shown in FIG. 1, in the case the gap $L_2$ between the first and second injection openings 12, 14 is made 1.5 mm, the distance $L_3$ from the gap to the outlet of the second injection opening 14 is made 8.5 mm and the diameter of the second injection opening 14 is made 2.5 mm, a circular cooling pattern is obtained which has a diameter of 75 mm at the distance of 500 mm from the second injection opening 14 similarly to the present embodiment, as shown in FIG. 5 A. In consideration of the above facts, it is readily known how the cooling capacity obtained by the present embodiment is excellent. In passing, if it is desired to enlarge the cooling area of this elliptical cooling pattern, the purpose can be easily achieved by decreasing the distance $L_1$ between the air introducing hole 44 to the injection openings 42. Additionally, according to the present invention, it is not necessary to particularly limit the water pressure and the air pressure and either one of the water pressure or the air pressure can be made higher than the other, and in the above embodiment, the experiments were conducted under the water pressure of 5 $Kg/cm^3$.

Figure 6A:
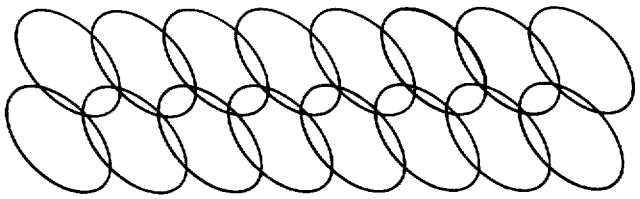
FIG. 6 A to FIG. 6 C are explanatory views showing cooling patterns in the respective embodiments.
Figure 6B:
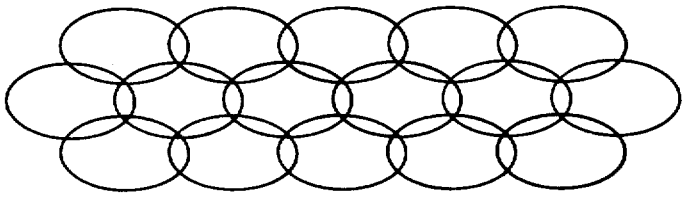
Figure 6C:
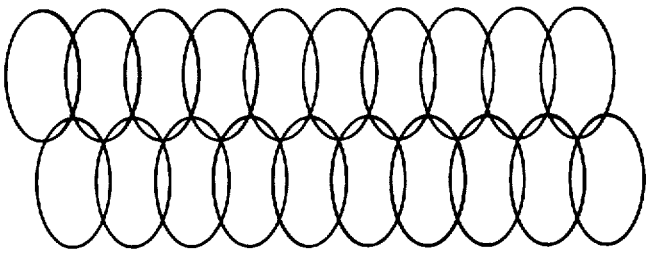

The cooling patterns by use of a plurality of injection pipes 30 according to the present invention as described above can be combined with the portions of the cooling patterns being overlapped with one another, thereby enabling to effect the efficient water cooling of steel plates. Such combinations of cooling patterns that are shown in FIG. 6 are conceivable for adoption by suitably controlling the number and arrangement of the injection pipes 40 and the positions and number of the air introducing holes 44.

The air supply pipe 22 communicated at one end thereof with the air supply hole 36 of the aforesaid injection nozzle 20 is communicated at the other end thereof with an air supply source 46, and the aforesaid constant flow rate device 24 is disposed at the intermediate portion of the air supply pipe 22. Further, provided between the constant flow rate device 24 and the injection nozzle 20 is a pressure gauge 48. Consequently, a given amount of air from the air supply source 46 is adapted to be supplied by the constant flow rate device 24 to the air supply hole 36 of the injection nozzle 20.

The water supply pipe 26 communicated at one end thereof with the water supply hole 34 of the aforesaid injection nozzle 20 is communicated at the other end thereof with a water supply source 50, and the aforesaid flow rate control valve 28 is disposed at the intermediate portion of the water supply pipe 26. With this arrangement, the flow rate of water supplied to the water supply hole 34 of the injection nozzle 20 can be desirably changed by the control of the flow rate control valve 28.

With the above arrangement in the present embodiment, in order to increase the cooling capacity by the injection of the two fluids from the injection nozzle 20, it is necessary to increase the air pressure and the amount of water supplied to the injection nozzle 20. This increase can be readily practicable. This is because the pressure of air supplied can be automatically increase by controlling the flow rate control valve 28 to increase the amount of water, i.e. pressure supplied to the injection nozzle 20. Namely, water and air pass through the injection pipe 40 of the injection nozzle 20 and are blown out of the injection hole 42, and the flow rate of air supplied to the injection pipe 40 is constant, while the amount of water supplied to the injection pipe 40 can be increased, and hence, in the injection pipe 40, air is compressed to be decreased in volume, whereby the pressure of air is increased. Consequently, only the increase in the amount of water supplied will result in automatical increase in the pressure of air supplied.

Furthermore, if it is desired to decrease the cooling capacity, it suffices to operate the flow rate control valve 28 to decrease the amount of water supplied, which leads to an automatical decrease in the pressure supplied to the injection pipe 40. In other words, only the operation of the flow rate control valve 28 can change the cooling capacity. In the conventional method of controlling, there have been required valves to control both water and air and the complicated operation of those valves. However, in the present embodiment, the cooling capacity may be desirably changed by the operation of the flow rate control valve 28.

Figure 7:
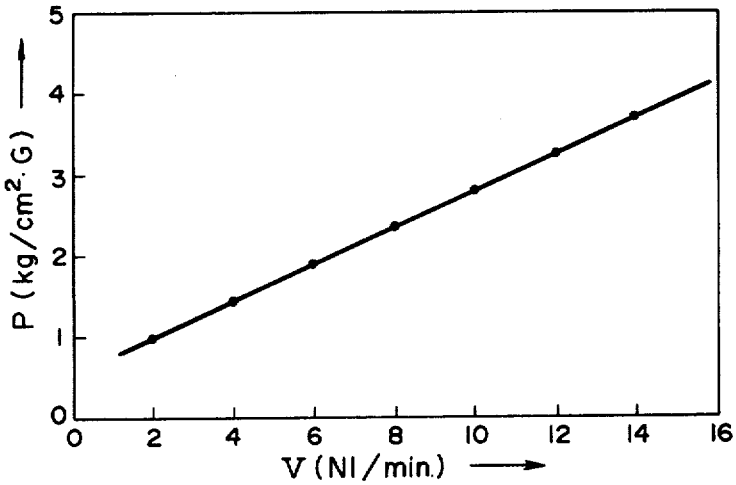
FIG. 7 is a diagram showing the relationship between the flow rate of water supplied and the pressure of air supplied in the present embodiment.

Next, FIG. 7 shows the relationship between the flow rate of water supplied V (Nl/min) and the pressure of air supplied P(kg/cm$^2$.G) in the present embodiment wherein nine injection pipes 28 of the injection nozzle 20 having an inner diameter of 2.5 mm are arranged, and a constant flow rate valve 24 having a flow rate of 500 Nl/min supplied to the injection nozzle 20 therefrom is used. Since the change in the flow rate of water results in a proportional change in the pressure of air, the reading the pressure of air supplied, which is indicated by a pressure gauge 48 will make the flow rate of water supplied, which is given as an abscissa, be correctly known, thereby enabling to control the cooling capacity over a large range by the injection nozzle 20.

As described above the characteristic diagrams each showing the relationship between the flow rate of water and the pressure of air in the respective injection nozzles are prepared in advance, whereby the flow rate of water supplied is known by measuring the pressure of air supplied to the injection nozzle, thereby enabling to extremely readily and correctly grasp the cooling capacity at the desired flow rate of water supplied or the disired pressure of air.

What is claimed is:

1. A steel stock cooling apparatus wherein a mixture of water with air is injected onto steel stocks for cooling, said apparatus comprising:

a main body;

injection pipes which are each communicated at one end thereof with a water supply section and each inject at the other end thereof water supplied from said water supply section;

at least one air introducing hole communicated with an air supply section is formed at the intermediate portion of each of the injection pipes;

said water supply section and air supply section are holes formed in said main body, respectively; and the axes of said holes are in parallel to each other.

2. A steel stock cooling apparatus as set forth in claim 1, characterized in that:

said water supply section and air supply section are columnar holes, respectively.

3. A steel stock cooling apparatus as set forth in claim 1, characterized in that:

said injection pipes are straight pipes perpendicularly intersecting the water supply section and air supply section.

4. A steel stock cooling apparatus as set forth in claim 1, characterized in that:

said air introducing hole or holes are through-holes perpendicularly intersecting the axes of the injection pipes.

5. A steel stock cooling apparatus as set forth in claim 2, characterized in that:

said water supply section and air supply section are provided therein with internal threads being connected to a water supply pipe and an air supply pipe.

6. A steel stock cooling apparatus as set forth in claim 5, characterized in that:

a flow rate control valve is provided at the intermediate portion of said water supply pipe; and a constant flow rate device is provided at the intermediate portion of said air supply pipe.

7. A steel stock cooling apparatus wherein a mixture of water with air is injected onto steel stocks for cooling, said apparatus comprising:

a main body;

a water supply hole comprising a cylindrical bore in said body;

an air supply hole comprising a cylindrical bore in said body parallel to said water supply hole;

injection pipes communicating with said water supply hole at one end, extending through said air supply hole and communicating with the exterior of said main body at the other end; and at least one air introducing hole provided in said injection pipe in that portion of said pipe extending through said air supply hole whereby water enters said one end of said injection pipe, air enters said air introducing hole and water and air is sprayed out of said other end of said injection pipe in an eliptical pattern.

* * * * *